US006859975B2

(12) United States Patent
Ohta et al.

(10) Patent No.: US 6,859,975 B2
(45) Date of Patent: Mar. 1, 2005

(54) VACUUM CLEANER

(75) Inventors: Hiroshi Ohta, Takatsuki (JP); Yasuhiro Oka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 293 days.

(21) Appl. No.: 10/088,165

(22) PCT Filed: Aug. 6, 2001

(86) PCT No.: PCT/JP01/06758

§ 371 (c)(1),
(2), (4) Date: Mar. 15, 2002

(87) PCT Pub. No.: WO02/11597

PCT Pub. Date: Feb. 14, 2002

(65) Prior Publication Data

US 2002/0133901 A1 Sep. 26, 2002

(30) Foreign Application Priority Data

Aug. 9, 2000 (JP) ..... 2000-240798

(51) Int. Cl.[7] ..... A47L 9/16

(52) U.S. Cl. ..... 15/347; 15/352; 15/353; 55/DIG. 3; 55/459.1

(58) Field of Search ..... 15/347, 350–353, 15/319; 55/429, 459.1, DIG. 3, 337; 96/423, 417

(56) References Cited

U.S. PATENT DOCUMENTS

| | | | | | |
|---|---|---|---|---|---|
| 1,913,115 | A | * | 6/1933 | Guest | 55/391 |
| 2,010,128 | A | * | 8/1935 | Arnold | 209/710 |
| 3,675,401 | A | * | 7/1972 | Cordes | 55/394 |
| 5,062,870 | A | | 11/1991 | Dyson | 55/213 |
| 5,604,954 | A | * | 2/1997 | Webster et al. | 15/330 |
| 5,907,886 | A | * | 6/1999 | Buscher | 15/319 |
| 6,026,540 | A | * | 2/2000 | Wright et al. | 15/347 |
| 6,090,174 | A | * | 7/2000 | Douma et al. | 55/337 |
| 6,195,835 | B1 | * | 3/2001 | Song et al. | 15/327.1 |
| 6,228,151 | B1 | * | 5/2001 | Conrad et al. | 95/271 |
| 6,269,518 | B1 | * | 8/2001 | Yung | 15/352 |
| 6,607,575 | B2 | * | 8/2003 | Oh et al. | 55/413 |
| 6,616,721 | B2 | * | 9/2003 | Oh | 55/426 |
| 6,679,930 | B1 | * | 1/2004 | An et al. | 55/337 |
| 2001/0054213 | A1 | * | 12/2001 | Oh et al. | 15/353 |

FOREIGN PATENT DOCUMENTS

| | | |
|---|---|---|
| GB | 2344278 A | 6/2000 |
| JP | 6-85753 | 11/1994 |
| JP | 2000-166829 | 6/2000 |
| JP | 2001-37687 A | 2/2001 |

OTHER PUBLICATIONS

GB Examination Report mailed Aug. 15, 2003 in corresponding GB application SN 0208196.6.

* cited by examiner

*Primary Examiner*—Robert J. Warden, Sr.
*Assistant Examiner*—Laura C Cole
(74) *Attorney, Agent, or Firm*—Nixon & Vanderhye P.C.

(57) ABSTRACT

A vacuum cleaner has a cyclone dust collector 4, arranged in a suction air passage, for separating dust by making sucked air into a whirling stream. The cyclone dust collector 4 has an inlet port 41*a* through which the sucked air is introduced, a dust collection chamber 41 for collecting separated dust, a lid 42 for opening and closing the dust collection chamber 41, an exhaust cylinder 44 through which the sucked air is discharged out of the dust collection chamber, and a shielding member 46 arranged below the exhaust cylinder 44. Dust is separated as a result of a whirling stream of air colliding with shielding ribs 46*b* and a circular portion 46*a* of the shielding member 46.

5 Claims, 9 Drawing Sheets

VACUUM CLEANER

TECHNICAL FIELD

The present invention relates to a vacuum cleaner having a cyclone dust collector that separates dust by making sucked air into a whirling stream.

BACKGROUND ART

A conventional vacuum cleaner having a cyclone dust collector is disclosed in Japanese Patent Application Published No. H6-85753. FIG. 8 is a perspective view of this vacuum cleaner. A cleaner body 101 has an electric blower (not shown) housed inside and has a nozzle (not shown) formed so as to face the floor surface. On top of the cleaner body 101, a cyclone dust collector 103 is supported so as to be pivotable back and forth.

FIG. 9 is a front sectional view of the cyclone dust collector 103. FIG. 10 is a sectional view taken along line D—D shown in FIG. 9. As shown in these figures, the cyclone dust collector 103 has a suction pipe 104 and an exhaust pipe 105 formed outside a cylindrical outer cyclone 113 integrally therewith. The outer cyclone 113 is composed of a transparent dust collector section 113*b* fitted integrally to an inlet section 113*c* located above it. In the inlet section 113*c* is formed an inlet port 113*a* through which air is introduced into the inlet section 113*c* substantially tangentially thereto from the suction pipe 104.

Between the suction pipe 104 and the exhaust pipe 105, a pipe 106 is arranged. The pipe 106 is fitted with a grip 107 (see FIG. 8) to be gripped by the user. By operating the grip 107, the user can move the vacuum cleaner 100 around smoothly, with casters 111 (see FIG. 8) rolling on the floor surface.

Inside the outer cyclone 113, an inner cyclone 114 having the shape of a truncated cone is arranged with the smaller-diameter end thereof down. The lower end of the inner cyclone 114 is open so as to communicate with a dust collection container 109 that is formed integrally with the outer cyclone 113. At the upper end of the inner cyclone 114, an exhaust section 110 having a circular passage is provided.

Outside the inner cyclone 114, a communicating passage 108 is formed. Through the communicating passage 108 and the exhaust section 110, the outer cyclone 113 and the inner cyclone 114 communicate with each other. At the center of the exhaust section 110, an exhaust port 110*a* is formed that communicates with the exhaust pipe 105.

In the vacuum cleaner 100 structured as described above, when the electric blower is driven, suction force appears at the nozzle, causing air to be sucked in through the nozzle. The sucked air then passes through the suction pipe 104, and flows into the outer cyclone 113 through the inlet port 113*a* in the direction indicated by arrow A1. Under centrifugal force, the sucked air is then made into a stream that whirls along the inner wall of the outer cyclone 113 while moving downward. Meanwhile, the sucked air collides with the inner wall of the outer cyclone 113, causing large particles of dust 112*a* to be separated and collected inside the outer cyclone 113.

Thereafter, the sucked air flows upward along the outer wall of the inner cyclone 114, then flows into the communicating passage 108 in the direction indicated by arrow A2, and then flows through the exhaust section 110 into the inner cyclone 114 in the direction indicated by arrow A3. Under centrifugal force, the sucked air that has flowed into the inner cyclone 114 is then made into a stream that whirls along the inner wall of the inner cyclone 114 while moving downward. Meanwhile, the sucked air collides with the inner wall of the inner cyclone 114, causing fine particles of dust 112*b* to be separated and collected inside the dust collection container 109.

Then, the sucked air having dust and the like removed therefrom flows upward in a central portion of the inner cyclone 114, and is discharged out of the cyclone dust collector 103 through the exhaust port 110*a* in the direction indicated by arrow A4. Then, the sucked air flows through the exhaust pipe 105 to the electric blower so as to be discharged out of the vacuum cleaner 100. In this way, dust is collected.

When the dust collector section 113*b*, which is integral with the dust collection container 109, is pulled out downwardly forward, the inlet section 113*c* is disengaged from the dust collector section 113*b* and the inner cyclone 114 is disengaged from the dust collection container 109. This permits the user to dispose of the large particles of dust 112*a* collected in the outer cyclone 113 and the fine particles of dust 112*b* collected in the dust collection container 109.

However, in the conventional vacuum cleaner described above, which has an outer cyclone 113 and an inner cyclone 114 provided inside the cyclone dust collector 103, the sucked air is made to flow downward and then upward in each of the outer and inner cyclones 113 and 114. This increases pressure loss, and thus lowers dust collecting performance. The pressure loss can be reduced by providing only one of the outer and inner cyclones 113 and 114, but this results in insufficient removal of fine particles of dust, leading to the clogging of the exhaust port 110*a* with fine particles of dust.

Moreover, when the dust collector section 113*b* is pulled out for the disposal of the collected dust and the like, the dust collector section 113*b* is open at the top. Thus, while the dust collector section 113*b* is being carried to a place where to dispose of dust, the collected dust is scattered about, degrading the hygiene of the environment and of the user's hands and fingers. Moreover, since dust and the like is collected at two locations, i.e. in the dust collector section 113*b* and the dust collection container 109, these two components both require cleaning, making their cleaning complicated.

DISCLOSURE OF THE INVENTION

An object of the present invention is to provide a vacuum cleaner that permits separation of dust without lowering dust collection performance. Another object of the present invention is to provide a vacuum cleaner that permits hygienic disposal of dust and easy cleaning of its dust collector section.

To achieve the above objects, according to the present invention, in a vacuum cleaner provided with a nozzle unit having a nozzle, an electric blower for sucking air, a suction air passage provided between the nozzle unit and the electric blower, and a cyclone dust collector, arranged in the suction air passage, for separating dust by making sucked air into a whiling stream, the cyclone dust collector is provided with a dust collection chamber, having an inlet port through which to introduce the sucked air, for collecting separated dust, a lid for opening and closing the dust collection chamber, and an exhaust cylinder through which to discharge the sucked air.

In this structure, when the electric blower is driven, the air sucked in through the nozzle is introduced into the suction air passage. On the way along the suction air passage is arranged the cyclone dust collector, and the sucked air that has flowed into the cyclone dust collector through the inlet port collides, in the form of a whirling stream, with the inner wall of the cyclone dust collector. Thus, dust is separated and collected in the dust collection chamber. The sucked air having dust removed therefrom is then discharged through the exhaust cylinder. The dust collection chamber is detached together with the lid from the cyclone dust collector, and, with the lid open, the dust collected in the dust collection chamber is disposed of.

According to the present invention, in the vacuum cleaner structured as described above, the exhaust cylinder may be detachable from the lid.

According to the present invention, the vacuum cleaner structured as described above may be further provided with exhaust cylinder detecting means for detecting that the exhaust cylinder is located in a predetermined position, so that the electric blower is controlled according to the result of detection by the exhaust cylinder detecting means. In this structure, the electric blower cannot be driven unless the detachable exhaust cylinder is located in the predetermined position.

According to the present invention, the vacuum cleaner structured as described above may be further provided with a shielding member with which a stream of air inside the dust collection chamber is made to collide to separate dust. In this structure, the sucked air that has flowed into the cyclone dust collector whirls around in the form of a whirling stream inside the dust collection chamber. As the whirling stream collides with the inner wall of the dust collection chamber and the shielding member, dust is separated, and the separated dust is collected in the dust collection chamber.

According to the present invention, in the vacuum cleaner structured as described above, the lid, the exhaust cylinder, and the shielding member may be integrally detachable from the dust collection chamber.

According to the present invention, in the vacuum cleaner structured as described above, the exhaust cylinder may be arranged above the shielding member and substantially on the center line of the dust collection chamber. In this structure, the whirling stream that has flowed into the dust collection chamber of the cyclone dust collector through the inlet port at high flow speed flows downward toward the bottom surface of the dust collection chamber while whirling around outside the exhaust cylinder and, as this whirling stream collides with the inner wall of the dust collection chamber and the shielding member, dust is separated. Thereafter, the sucked air flows, now at low flow speed, upward inside the dust collection chamber and is discharged out of the exhaust cylinder.

According to the present invention, in the vacuum cleaner structured as described above, the shielding member may have a circular portion having a substantially circular shape and arranged inside the dust collection chamber with a gap secured from the, inner wall thereof and a protruding portion formed so as to protrude downward from the periphery of the circular portion. In this structure, the sucked air that has flowed into the cyclone dust collector is made into a whirling stream, and large particles of dust are separated above the circular portion. Thereafter, the whirling stream flows through the gap between the circular portion and the inner wall of the dust collection chamber to below the circular portion, then reaches the bottom surface of the dust collection chamber, and then flows upward in a substantially central portion of the dust collection chamber. The stream of air that has flowed up collides with the circular portion and flows radially outward. The stream of air then collides with the protruding portion and flows downward. Part of the stream of air circulates inside the dust collection chamber and is then discharged through the exhaust port.

According to the present invention, in the vacuum cleaner structured as described above, the shielding member may have a plurality of shielding ribs arranged radially on the bottom surface of the circular portion so as to protrude downward therefrom. In this structure, the whirling stream that has flowed to below the circular potion collides with the shielding ribs, so that dust is separated.

According to the present invention, in the vacuum cleaner structured as described above, between two adjacent shielding ribs, a projection rib may be formed so as to protrude from the inner wall of the dust collection chamber toward the center thereof. In this structure, the sucked air the whirls around between the shielding ribs and the inner wall of the dust collection chamber collides with the projection rib, so that dust is separated.

According to the present invention, in the vacuum cleaner structured as described above, the cyclone dust collector may be integrally detachable from the suction passage.

According to the present invention, the vacuum cleaner structured as described above may be further provided with dust collector detecting means for detecting that the cyclone dust collector is located in a predetermined position, so that the electric blower is controlled according to the result of detection by the dust collector detecting means.

BEST MODE FOR CARRYING OUT THE INVENTION

Figure 1:
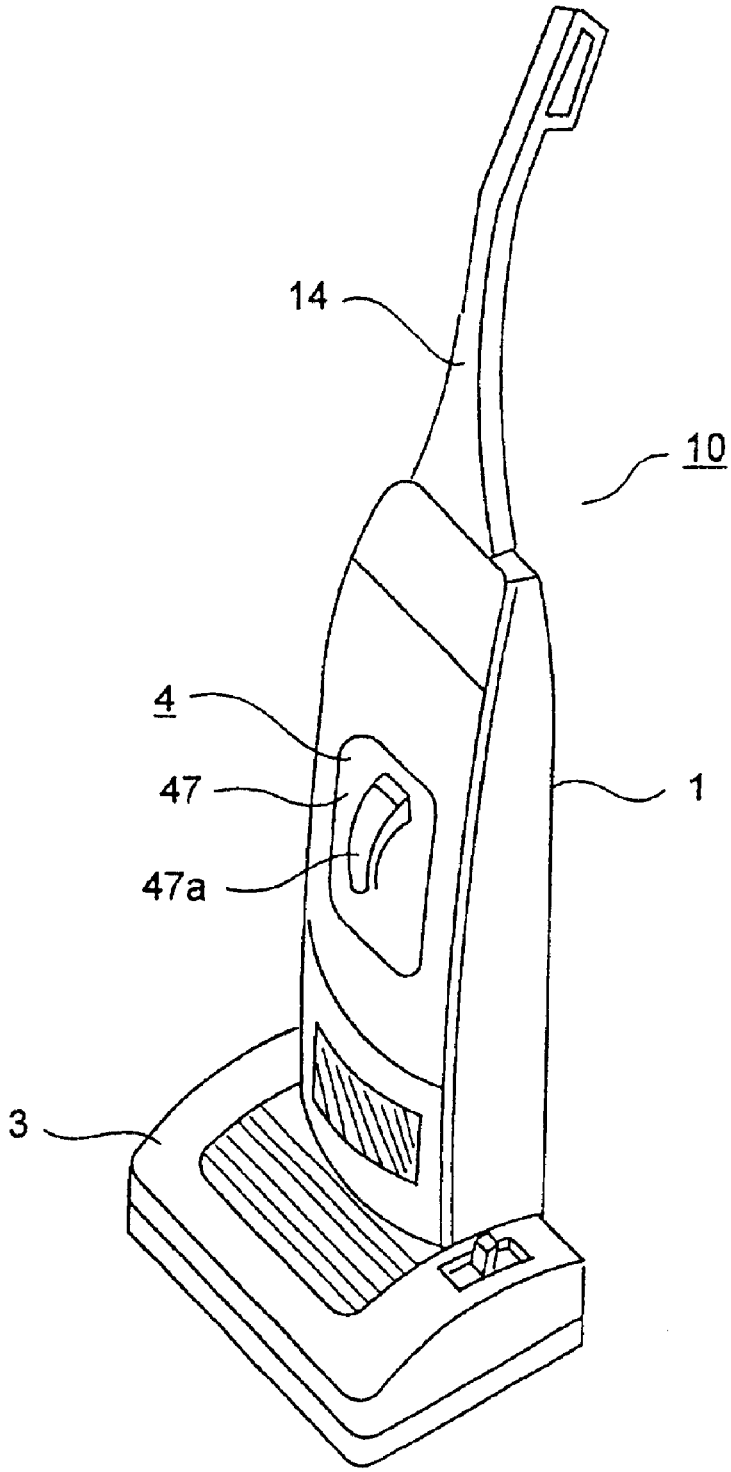
FIG. 1 is an external perspective view of the vacuum cleaner of a first embodiment of the invention.
Figure 2:
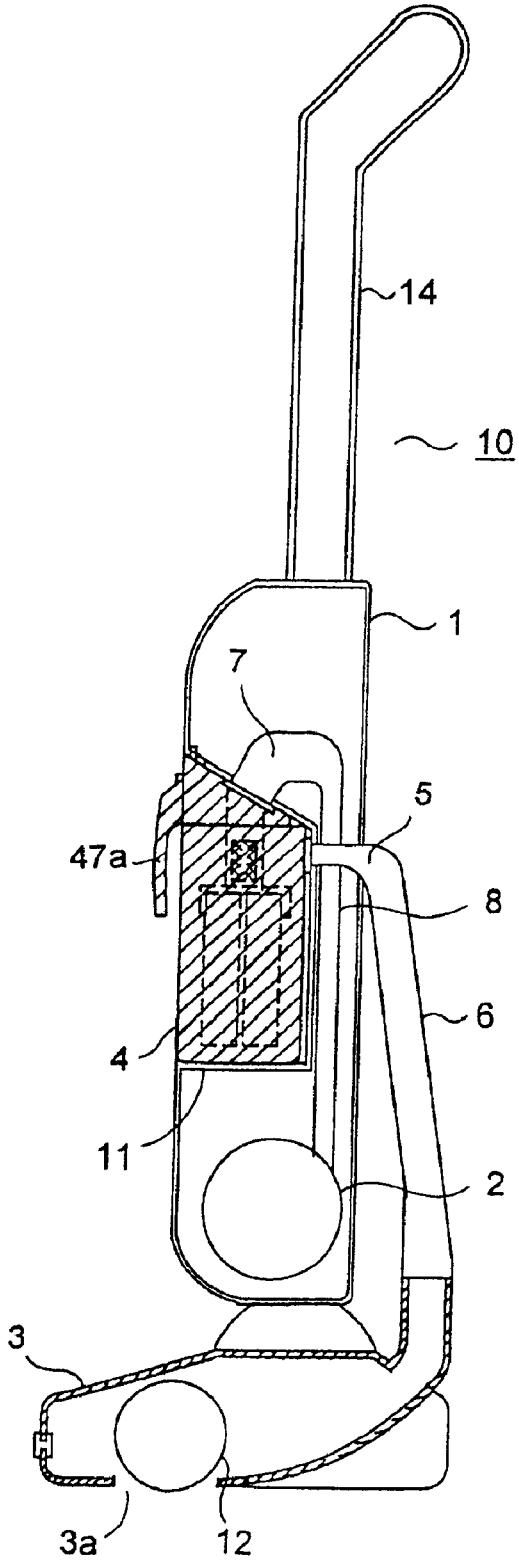
FIG. 2 is a side sectional view of the vacuum cleaner of the first embodiment of the invention.

Hereinafter, embodiments of the present invention will be described with reference to the drawings. FIGS. 1 and 2 are respectively an external perspective view and a side sectional view of the upright-type vacuum cleaner of a first embodiment of the invention. The vacuum cleaner 10 has a cleaner body 1 having an electric blower 2 housed therein, and, to the cleaner body 1, a nozzle unit 3 having a nozzle 3*a* open toward the floor is fitted in such a way as to be pivotable within a predetermined range of angles.

To the cleaner body 1, a cyclone dust collector 4 is detachably fitted. Inside the nozzle unit 3, a rotary brush 12 is provided so as to face the nozzle 3*a*. Moreover, on top of the cleaner body 1, a grip 14 to be griped by the user is provided so that, by operating the grip 14, the user can move the vacuum cleaner 10 back and forth.

Figure 3:
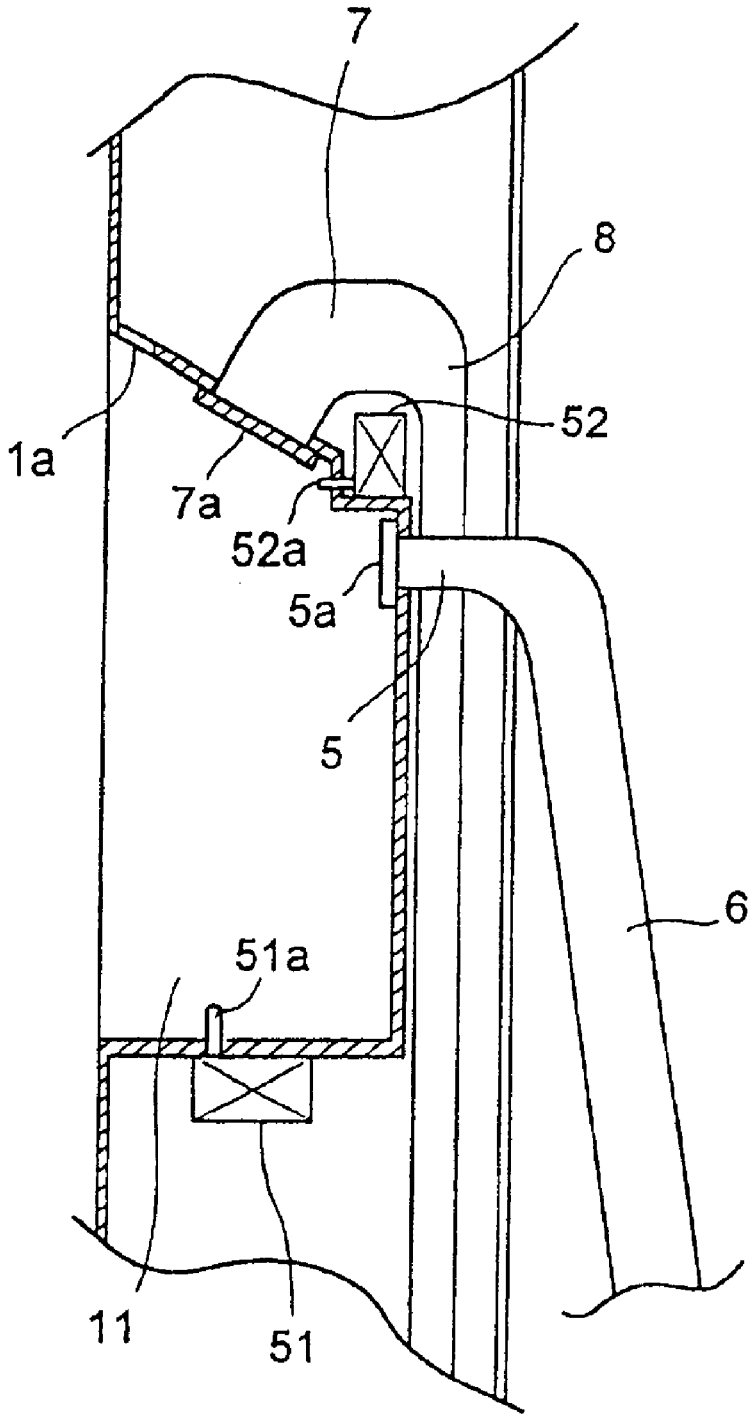
FIG. 3 is a side sectional view showing a principal portion of the vacuum cleaner of the first embodiment of the invention, in its state with the cyclone dust collector detached therefrom.

FIG. 3 shows a principal portion of the cleaner body 1, in its state with the cyclone dust collector 4 detached therefrom. The cyclone dust collector 4 fits into a recess 11 formed in the cleaner body. In the recess 11, a body-side inlet port 5 is formed, and the body-side inlet port 5 is connected to the nozzle unit 3 by a suction pipe 6.

Around the body-side inlet port 5, a seal 5*a* made of an elastic material such as rubber is fitted so as to be kept in intimate contact with the rim of an inlet port 41*a* (see FIG. 4) of the cyclone dust collector 4 described later. This permits the air sucked in through the nozzle 3*a* to be introduced into the cyclone dust collector 4. Moreover, as will be described later, in the recess 11, detectors 51 and 52 for detecting the presence of the cyclone dust collector 4 and of an exhaust cylinder 44 (see FIG. 4) are provided.

The suction side of the electric blower 2 is connected to a body-side exhaust port 7 formed in the recess 11 by an exhaust pipe 8. Around the body-side exhaust port 7, a seal 7*a* made of an elastic material such as rubber is fitted so as to be kept in intimate contact with the rim of an exhaust section 42*a* (see FIG. 4) of the cyclone dust collector 4 described later. This permits the sucked air passing through the cyclone dust collector 4 to be introduced into the electric blower 2.

When the electric blower 2 is driven, a stream of sucked air is produced, which lowers the pressure inside the suction air passage composed of the exhaust pipe 8, the cyclone dust collector 4, and the suction pipe 6. Thus, the dust on the floor is, together with air, sucked through the nozzle 3*a* of the nozzle unit 3 by the electric blower 2.

Figure 4:
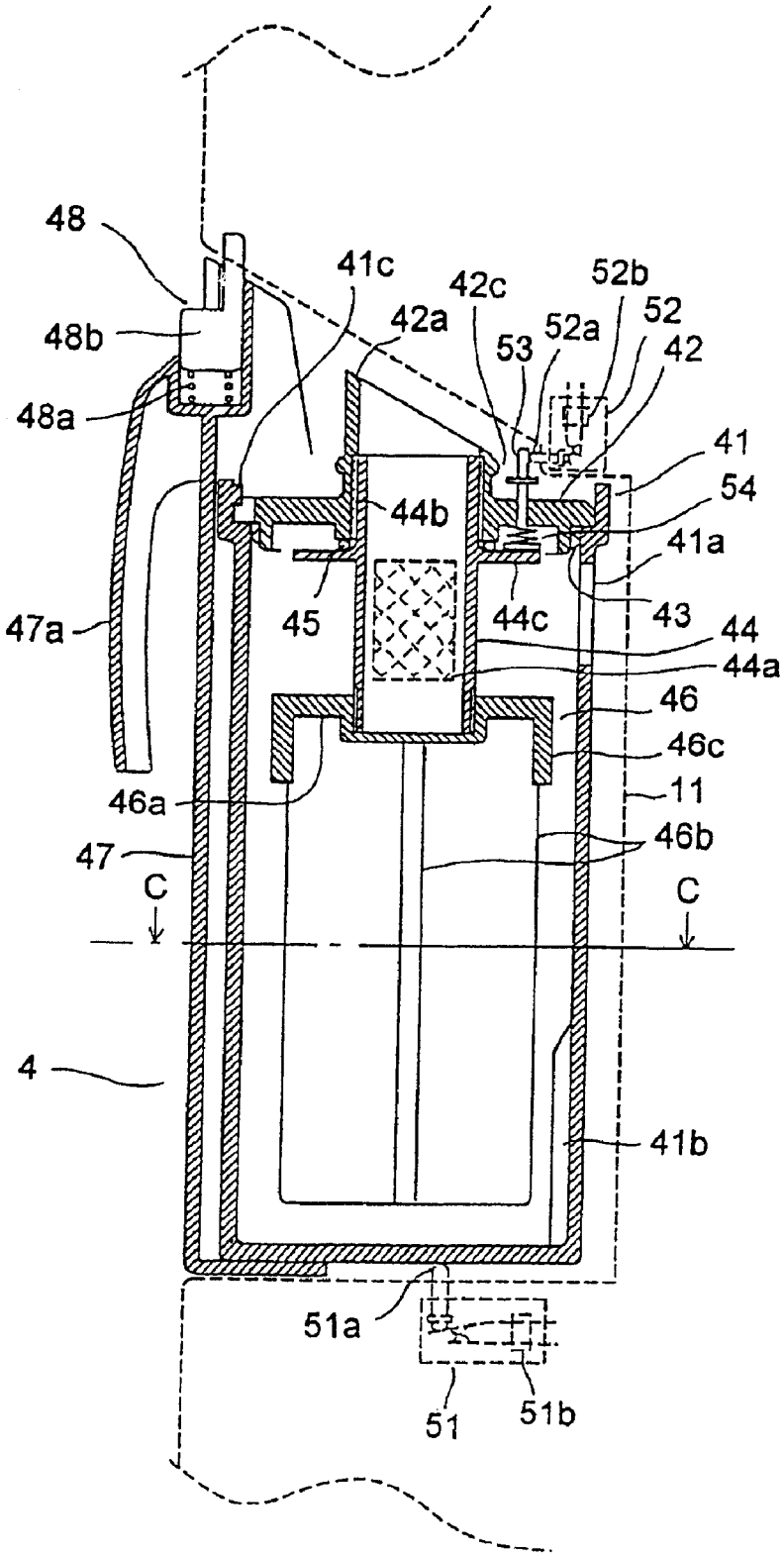
FIG. 4 is a side sectional view of the cyclone dust collector of the vacuum cleaner of the first embodiment of the invention.
Figure 5:
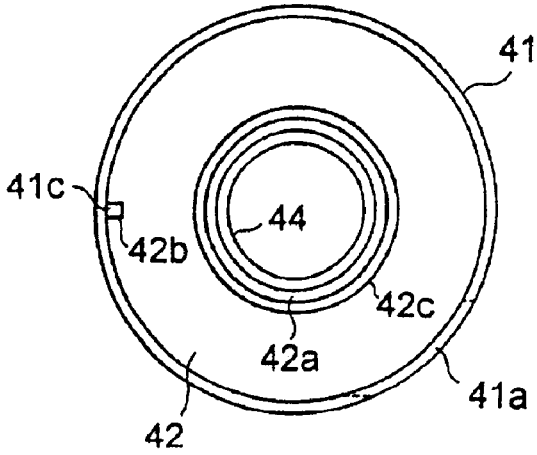
FIG. 5 is a top view of the cyclone dust collector of the vacuum cleaner of the first embodiment of the invention.
Figure 6:
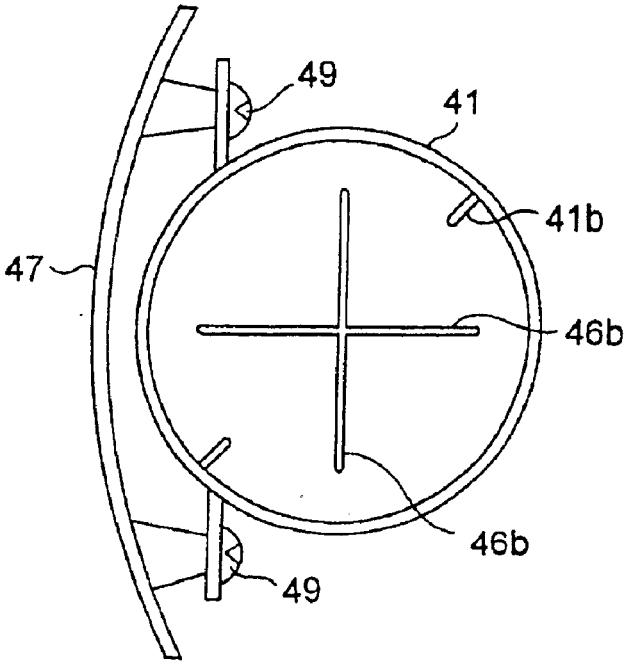
FIG. 6 is a sectional view of the cyclone dust collector of the vacuum cleaner of the first embodiment of the invention, taken along line C—C shown in FIG. 4.

FIG. 4 is a sectional view showing the cyclone dust collector 4 in detail. FIGS. 5 and 6 are respectively a top view of the cyclone dust collector 4 and a sectional view thereof taken along line C—C shown in FIG. 4. A dust collection chamber 41 is substantially cylindrical in shape, and has an inlet port 41*a* formed so as to permit a stream of air to be introduced along the inner wall thereof. The top of the dust collection chamber 41 can be opened and closed by detaching and attaching a lid 42. Around the lid 42, a seal 43 made of an elastic material such as rubber is fitted to permit the top of the dust collection chamber 41 to be closed hermetically.

At the periphery of the lid 42, a cut 42*b* is formed. On the inner wall of the dust collection chamber 41, in a position corresponding to the cut 42*b*, a projection 41*c* is formed. This helps keep the direction of the lid 42 fixed when it is attached to the dust collection chamber 41.

Substantially at the center of the lid 42, an exhaust section 42*a* is provided. As described earlier, the top end of the exhaust section 42*a* is kept in intimate contact with the seal 7*a* (see FIG. 3) and communicates with the body-side exhaust port 7. To the exhaust section 42*a*, an exhaust cylinder 44 is detachably fixed by a screw portion 44*b*, with a seal 45 made of rubber or the like placed in between.

Around the outer surface of the exhaust section 42*a*, a grip 42*c* is formed so as to protrude therefrom. By gripping the grip 42*c*, the user can easily detach the lid 42 from the dust collection chamber 41. The exhaust section 42*a* may be formed integrally with the exhaust cylinder 44 and detachably fitted to the lid 42 with a screw or the like.

To the lid 42, a movable pin 53 is fitted so as to be vertically movable. The movable pin 53 is loaded with a force that presses it downward by a spring 54. On the exhaust cylinder 44, a brim portion 44*c* is formed so that, when the exhaust cylinder 44 is screw-engaged with the lid 42, the movable pin 53 protrudes upward-against the force with which it is loaded.

Above the recess 11 of the cleaner body 1, a detector 52 for detecting the presence of the exhaust cylinder 44 is provided. Moreover, below the recess 11, a detector 51 for detecting the presence of the cyclone dust collector 4 is provided. The detectors 51 and 52 respectively have detecting portions 51*a* and 52*a* and switch portions 51*b* and 52*b*.

When the cyclone dust collector 4 is fitted in the recess 11 normally, the bottom surface of the dust collection chamber 41 presses the detecting portion 51*a* and thereby turns the switch portion 51*b* on. When the exhaust cylinder 44 is fitted to the lid 42 normally, and the lid 42 is fitted in a predetermined position relative to the dust collection chamber 41, the movable pin 53 presses the detecting portion 52*a* and thereby turns the switch portion 52*b* on.

The electric blower 2 (see FIG. 2) can be driven only when the switch portions 51*b* and 52*b* are both on. Therefore, unless the dust collection chamber 41, the lid 42, and the exhaust cylinder 44 are fitted in predetermined positions, the electric blower 2 is not driven. This prevents the failure of the electric blower 2 resulting from, when the user has forgotten to fit the cyclone dust collector 4 or the exhaust cylinder 44, the electric blower 2 sucking air directly from the recess 11 into exhaust pipe 8, thus receiving an extremely light load and rotating at an extremely high rotation rate. Moreover, it is also possible to prevent the dust sucked in through the nozzle 3*a* from being scattered about in the surroundings. The detecting portions 51*a* and 52*a* may be realized with proximity switches, optical sensors, or the like.

The exhaust cylinder 44 is cylindrical in shape, and in the peripheral surface thereof is formed an exhaust port 44*a* that permits the inside and outside of the exhaust cylinder 44 to communicate with each other. The exhaust port 44*a* is formed as mesh. At the bottom end of the exhaust cylinder 44, a shielding member 46 is detachably fitted with a screw or the like. The shielding member 46 is composed of a circular portion 46*a* that is circular in shape and ribs 46*b* that are formed under the circular portion 46*a*. The shielding member 46 closes the bottom end of the exhaust cylinder 44.

Around the rim of the circular portion 46*a*, a protruding portion 46*c* is formed so as to protrude downward therefrom. Between the protruding portion 46*c* and the inner wall of the dust collection chamber 41, a predetermined gap is secured. The ribs 46*b* are arranged radially so as to extend from the center to the periphery of the circular portion 46*a*. In this embodiment, the ribs 46*b* as a whole have a cross-shaped cross section.

On the inner wall of the dust collection chamber 41, ribs 41*b* are formed between every two adjacent ribs 46*b* so as to extend from the inner wall toward the center of the dust collection chamber 41. The dust collection chamber 41 is fixed to a cover 47 with screws 49. The cover 47 has a unified outward design with the cleaner body 1, and, in a grip 47*a* of the cover 47 and the cleaner body 1, a locking means 48 for unlockably locking the cover 47 is provided.

The locking means 48 has a spring 48*a* pressing a locking piece 48*b* toward the cleaner body 1. When the cyclone dust collector 4 is fitted in the recess 11, the locking piece 48*b* engages with a locking hole la (see FIG. 3). The cover 47 and the dust collection chamber 41 may be formed integrally out of the same material. Part or the whole of the cover 47 and the dust collection chamber 41 may be formed out of a transparent material, with a line marked thereon to indicate the time for dust disposal. This enhances the usability of the vacuum cleaner.

In the upright-type vacuum cleaner 10 structured as described above, when the electric blower 2 is driven, a stream of air containing dust is sucked in through the nozzle 3*a* of the nozzle unit 3, passes through the suction pipe 6 and the body-side inlet port 5, and flows into the dust collection chamber 41 through the inlet port 41*a*. The stream of air flows into the dust collection chamber 41 along the inner wall thereof, and is thereby formed into a stream that whirls around inside the dust collection chamber 41. The stream of air is then sucked through the exhaust port 44*a* of the exhaust cylinder 44, the exhaust section 42*a*, and the exhaust pipe 8 by the electric blower 2.

By the centrifugal force of the stream of air whirling around in the dust collection chamber 41, dust is driven toward the periphery, i.e. the inner wall, of the dust collection chamber 41. Large particles of dust and the like that cannot pass through the gap between the protruding portion 46*c* and the inner wall of the dust collection chamber 41 are separated and collected on top of the circular portion 46*a*. The whirling stream that has flowed in through the inlet port 41*a* flows at high flow speed, and thus whirls around outside the exhaust cylinder 44. This prevents air containing dust from being discharged directly, and thus alleviates the clogging of the exhaust port 44*a*.

The whirling stream flows through the gap between the protruding portion 46*c* and the inner wall of the dust collection chamber 41 to below the circular portion 46*a*. The whirling stream then collides with the inner wall of the dust collection chamber 41 and the ribs 46*b*, so that dust is separated. Moreover, the whirling stream that whirls around outside the ribs 46*b* collides with the ribs 41*b* formed on the inner wall of the dust collection chamber 41, so that dust is separated and is prevented from whirling around. Thus, dust is collected at the bottom of the dust collection chamber 41.

Arranging the ribs 41*b* not on the same radii as the ribs 46*b* but between every two adjacent ribs 46*b* permits the stream of air to whirl smoothly in a zigzag. This helps prevent an undue increase in pressure loss, and thus makes it possible to remove dust while discharging air efficiently.

The whirling stream that flows downward at decreasing flow speed after the collision with the ribs 46*b* reaches the bottom surface of the dust collection chamber 41, and then flows upward in a substantially central portion of the dust collection chamber 41. Here, even if some of the dust collected at the bottom of the dust collection chamber 41 is carried by this stream of air, it is removed when the stream of air flows upward and collides with the circular portion 46*a*.

Thereafter, the stream of air flows outward along the bottom surface of the circular portion 46*a*, then collides with the protruding portion 46*c*, and then flows downward. This prevents dust from flowing to above the circular portion 46*a*, and thus permits part of the stream of air to circulate inside the dust collection chamber 41, making efficient removal of dust possible. Then, the air having dust removed therefrom passes outside the protruding portion 46*c*, and is discharged through the exhaust port 44*a* of the exhaust cylinder 44.

The dust collected in the dust collection chamber 41 is disposed of in the following manner. The locking piece 48*b* is pressed down against the force exerted by the spring 48*a* to disengage it from the locking hole 1*a*. Then, with the grip 47*a* held in the user's hand, the cyclone dust collector 4 is integrally detached from the cleaner body 1. Then, the cyclone dust collector 4 is carried to a place where to dispose of dust. Then, with the grip 42*c* of the exhaust section 42*a* held in the user's hand, the lid 42 integral with the exhaust cylinder 44 and the shielding member 46 is detached, and the dust is disposed of.

In this way, the dust collected in the dust collection chamber 41 can be easily disposed of The lid 42 closes the greater part of the top of the dust collection chamber 41. This prevents the collected dust from being scattered about when the cyclone dust collector 4 is carried around, and thus helps minimize the degradation of the hygiene of the environment and of the user's hands and fingers. The lid 42, the exhaust cylinder 44, and the shielding member 46 are separable from one another, and this makes them easy to clean with a brush or with water.

When the disposal of dust and the cleaning of the lid 42 and the like is complete, the exhaust cylinder 44, the shielding member 46, and the lid 42 are assembled together, and the cut 42*b* and the projection 41*c* are engaged together so that the lid 42 is fitted to the dust collection chamber 41. As a result, the top of the dust collection chamber 41 is hermetically sealed by the seal 43 fitted around the lid 42, and the direction of the exhaust section 42*a* is kept fixed.

When the cyclone dust collector 4 is fitted in the recess 11, the force exerted by the spring 48*a* makes the locking piece 48*b* of the locking means 48 engage with the locking hole 1*a* of the cleaner body 1, so that the cyclone dust collector 4 is held in the cleaner body 1. Thus, the body-side inlet port 5 comes into intimate contact with the inlet port 41*a* of the dust collection chamber 41 through the seal 5*a*, and the end of the exhaust section 42*a* comes into intimate contact with the body-side exhaust port 7 through the seal 7*a*, forming the suction air passage.

Figure 7:
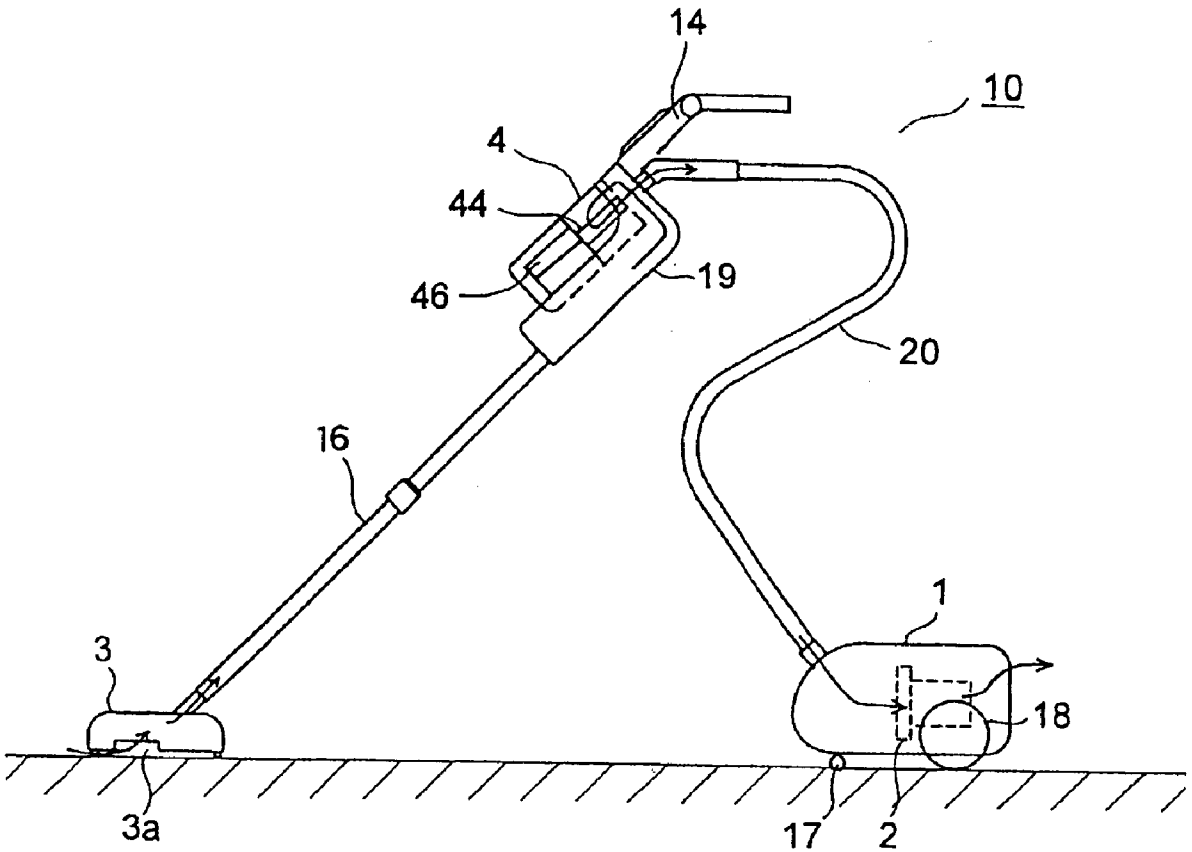
FIG. 7 is an external view of the vacuum cleaner of a second embodiment of the invention.
Figure 8:
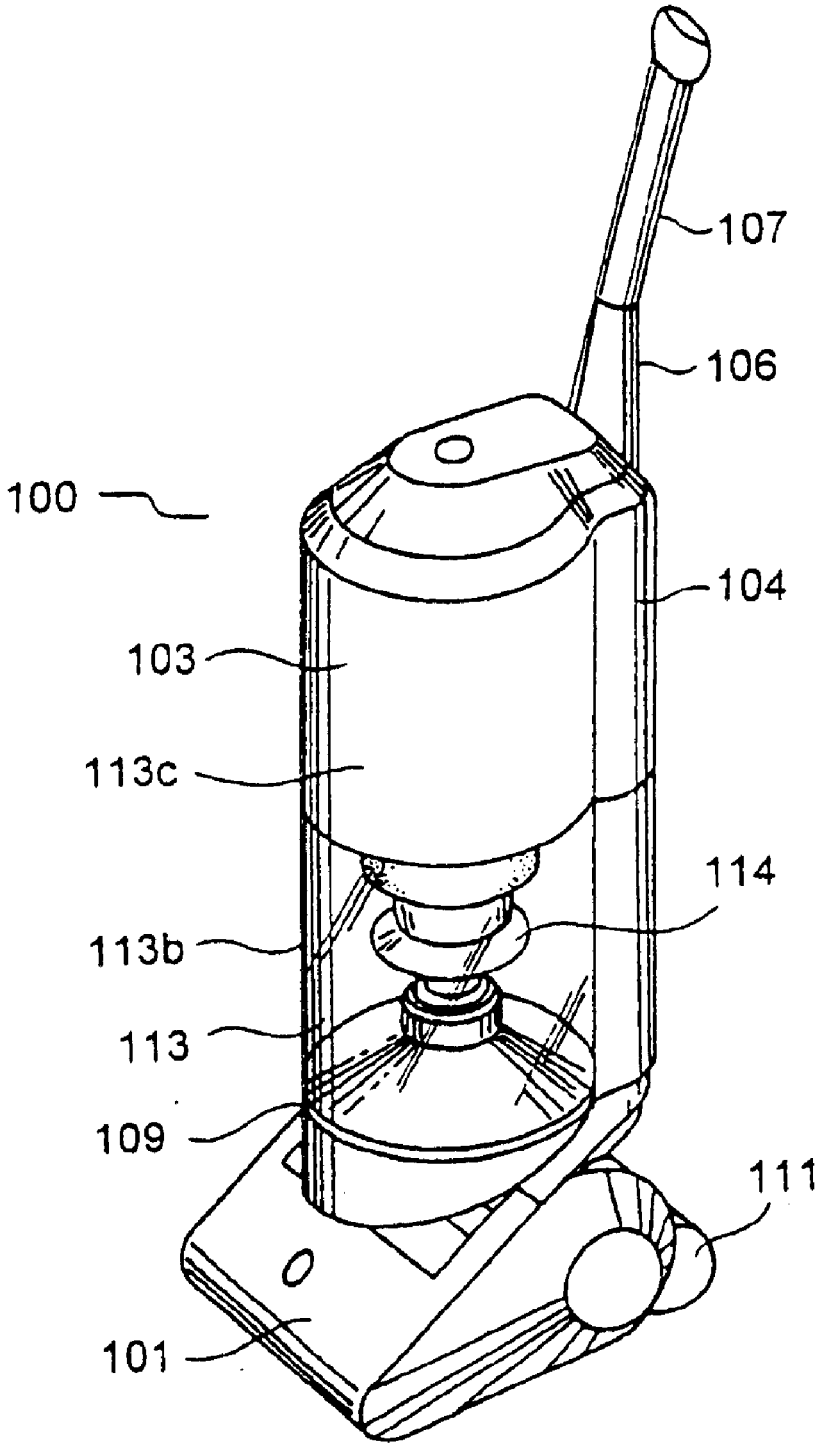
FIG.8 (Prior Art)
FIG. 8 is an external perspective view of a conventional vacuum cleaner.
Figure 9:
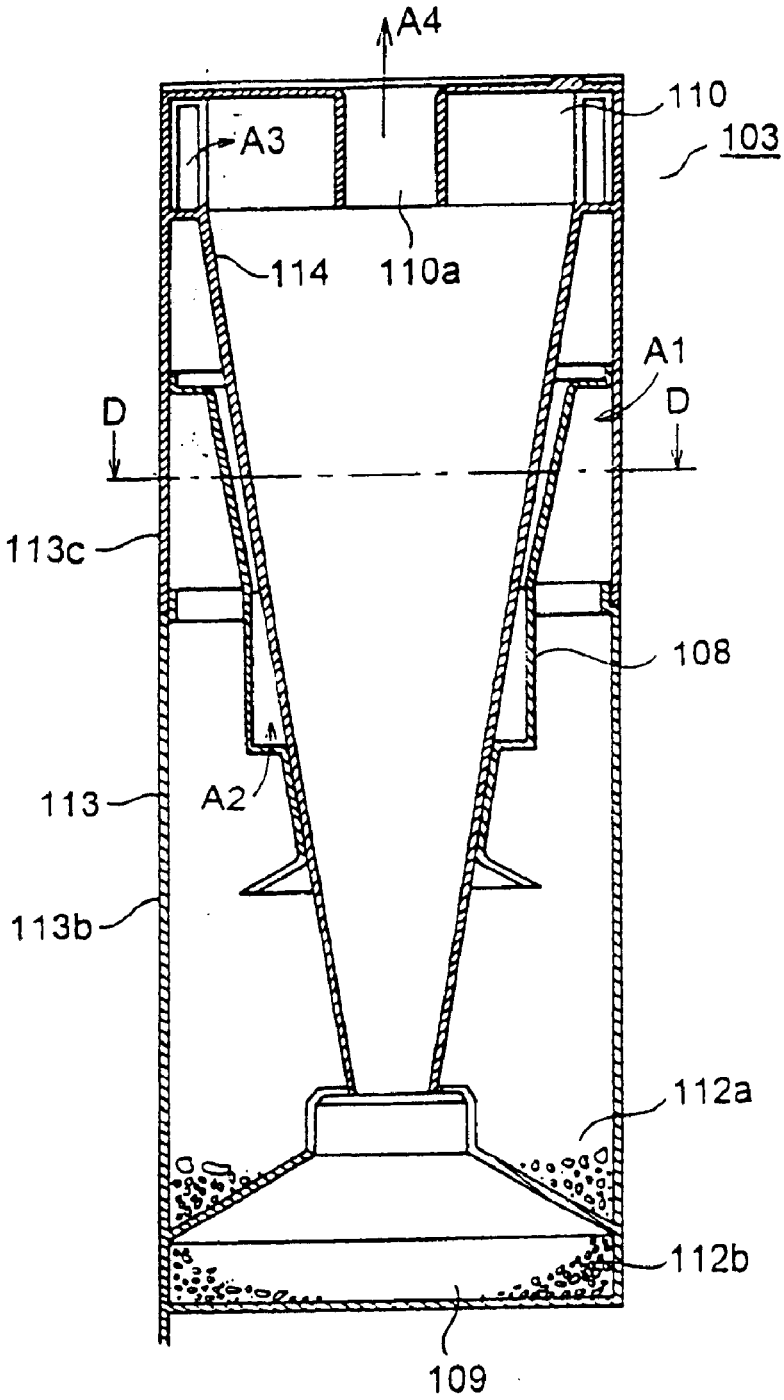
FIG.9 (Prior Art)
FIG. 9 is a front sectional view of the cyclone dust collector of the conventional vacuum cleaner.
Figure 10:
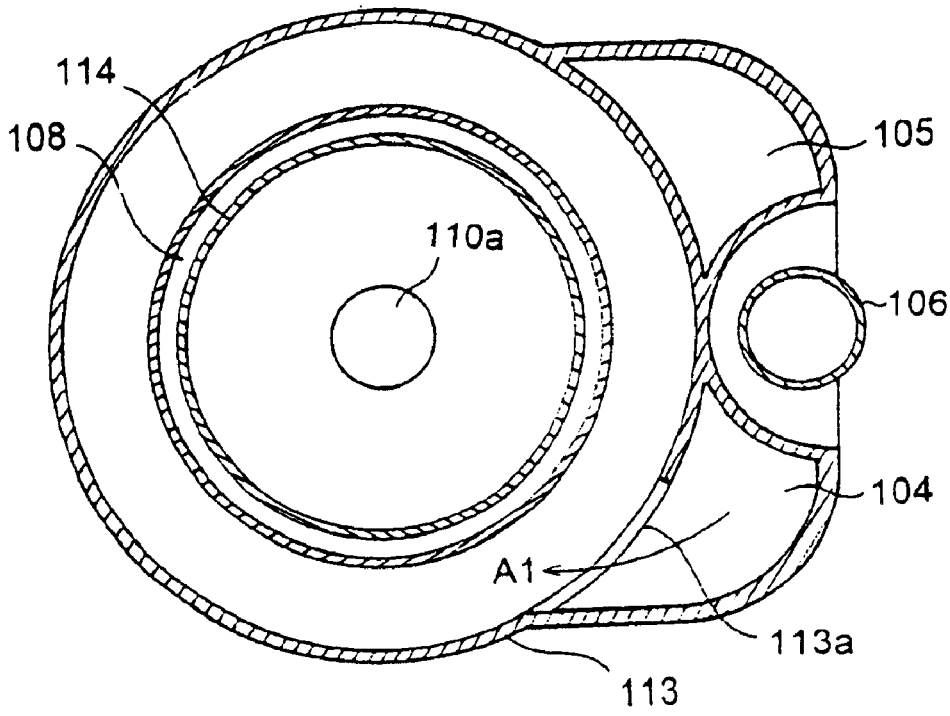
FIG.10 (Prior Art)
FIG. 10 is a sectional view of the cyclone dust collector of the conventional vacuum cleaner, taken along line D—D shown in FIG. 9.

FIG. 7 is an external view of the vacuum cleaner of a second embodiment of the invention. The vacuum cleaner 10 has an electric blower 2 housed inside a cleaner body 1, and has casters 17 and 18 fitted to the cleaner body 1. These casters 17 and 18 permit the cleaner body 1 to move around on a floor surface. Moreover, a flexible hose 20 is connected to the cleaner body 1 so as to communicate with the electric blower 2.

On the other hand, a nozzle unit 3 to be placed on the floor surface has a nozzle 3*a* formed so as to open toward the floor surface, and an extension pipe 16 is connected to the nozzle unit 3 so as to communicate with the nozzle 3*a*. The hose 20 and the extension pipe 16 are coupled together by a connecting member 19. Part of the connecting member 19 is formed into a grip portion 14 to permit the user to move the nozzle unit 3 around. In the connecting member 19 are formed a body-side inlet port (not shown) that communicates with the extension pipe 16 and a body-side exhaust port (not shown) that communicates with the hose 20.

In the connecting member 19, a cyclone dust collector 4 structured in the same manner as that described above and shown in FIG. 4 is fitted. The cyclone dust collector 4 has an inlet port and an exhaust port (see FIG. 4) formed therein so as to face and communicate with the body-side inlet port and the body-side exhaust port, respectively, with seals (not shown) fitted in between so as to keep their rims in intimate contact with each other. Thus, the nozzle 3*a*, the extension pipe 16, the cyclone dust collector 4, and the hose 20 form a suction air passage.

When the electric blower 2 is driven, suction force appears in the suction air passage. Thus, a stream of air containing dust is sucked in through the nozzle 3*a* of the nozzle unit 3, passes through the extension pipe 16, and flows into the dust collection chamber 41 through the inlet port 41*a* (see FIG. 4). Here, the stream of air flows into the dust collection chamber 41 along the inner wall thereof, and is thus formed into a stream that whirls around inside the dust collection chamber 41. The stream of air then flows through the exhaust port 44*a* of the exhaust cylinder 44 provided in a central portion of the dust collection chamber 41, then through the exhaust section 42*a*, and then through the hose 20, and is then sucked by the electric blower 2.

In this embodiment, the cyclone dust collector 4 has the same structure as in the first embodiment. That is, the provision of the shielding member 46 permits efficient separation of dust without increasing pressure loss. Moreover, the provision of the lid 42 permits the user to move with the lid fitted when he or she is going to dispose of dust, and thus helps maintain the hygiene of the environment and of the user's hands and fingers.

INDUSTRIAL APPLICABILITY

As described above, according to the present invention, a lid is provided on the dust collection chamber of a cyclone dust collector. This permits the user to move with the lid fitted when he or she is going to dispose of dust, and thus helps maintain the hygiene of the environment and of the user's hands and fingers. Moreover, an exhaust cylinder is provided so as to be detachable from the lid, and is thus easy to clean with a brush or with water.

Moreover, according to the present invention, a stream of air is made to collide with a shielding member provided inside the cyclone dust collector. This makes it possible to separate and collect dust efficiently while preventing dust from being raised by the whirling stream of air.

Moreover, according to the present invention, the lid, the exhaust cylinder, and the shielding member are detachable from the dust collection chamber. This permits easy disposal of the dust collected in the dust collection chamber.

Moreover, according to the present invention, the exhaust cylinder is arranged substantially at the center above the shielding member. Thus, the whirling stream that flows in through an inlet port at high flow speed whirls around outside the exhaust cylinder, and the stream of air that flows at low flow speed after the collision with the shielding member is discharged through the exhaust cylinder arranged at the center above. This ensures efficient separation of dust while preventing the clogging of the exhaust cylinder.

Moreover, according to the present invention, the shielding member has a circular portion that is circular in shape and arranged with a gap secured from the inner wall of the dust collection chamber and a protruding portion formed so as to protrude downward from the periphery of the circular portion. Thus, even if part of the collected dust is carried by the stream of air that has been cleared of dust and has reached the bottom surface of the dust collection chamber, it is separated as the stream of air flows upward and collides with the circular portion. Moreover, the stream of air is then made to flow outward along the bottom surface of the circular portion, then collide with the protruding portion, and then flow downward so that dust does not flow to above the circular portion and that part of the stream of air circulates inside the dust collection chamber. This makes efficient removal of dust possible.

Moreover, according to the present invention, the whirling stream is made to collide with shielding ribs arranged radially on the bottom surface of the circular portion. This makes more efficient removal of dust possible.

Moreover, according to the present invention, between two adjacent shielding ribs, a projection rib is formed so as to protrude from the inner wall toward the center of the dust collection chamber. This permits the whirling stream passing outside the shielding ribs to collide with the projection rib, and thereby makes efficient removal of dust possible. Moreover, this permits smooth passage of the whirling stream without an undue increase in pressure loss.

Moreover, according to the present invention, the cyclone dust collector is integrally detachable from the cleaner body. This makes easy disposal of dust and the like possible.

Moreover, according to the present invention, a dust collector detecting means and an exhaust cylinder detecting means for detecting that the cyclone dust collector and the exhaust cylinder are fitted in predetermined positions are provided so that an electric blower is controlled according to their detection results. This prevents the failure of the electric blower resulting from, when the user has forgotten to fit the cyclone dust collector or the exhaust cylinder, the electric blower receiving an extremely light load and rotating at an extremely high rotation rate. Moreover, it is also possible to prevent the dust sucked in through the nozzle from being scattered about in the surroundings.

What is claimed is:

1. A vacuum cleaner comprising:

a nozzle unit having a nozzle, an electric blower for sucking air, a suction air passage provided between the nozzle unit and the electric blower, and a cyclone dust collector, arranged in the suction air passage, for separating dust by making sucked air into a whirling stream, wherein the cyclone dust collector comprises:

a dust collection chamber for collecting dust, the dust collection chamber having an inlet port through which to introduce the sucked air, a lid for selectively opening and closing the dust collection chamber, the lid comprising an exhaust port through which to discharge sucked air out of the dust collection chamber, and an exhaust cylinder detachably fitted to the exhaust port of the lid, a shielding member detachably fitted to a bottom end of the exhaust cylinder, wherein the shielding member closes off the bottom end of the exhaust cylinder so that air entering the exhaust cylinder enters the exhaust cylinder through a port located in a peripheral edge of the exhaust cylinder, and wherein the shielding member is located above an area of the dust collecting chamber where dust is collected, and wherein the shielding member includes a plurality of elongated ribs extending downwardly from a top portion thereof for separating dust from the air in the dust collection chamber.

2. A vacuum cleaner as claimed in claim 1, further comprising exhaust cylinder detecting means for detecting that the exhaust cylinder is located in a predetermined position, wherein the electric blower is controlled according to a result of detection by the exhaust cylinder detecting means.

3. A vacuum cleaner as claimed in claim 1, wherein the cyclone dust collector is integrally detachable from the suction passage.

4. A vacuum cleaner as claimed in claim 3, further comprising dust collector detecting means for detecting that the cyclone dust collector is located in a predetermined position, wherein the electric blower is controlled according to a result of detection by the dust collector detecting means.

5. A vacuum cleaner as claimed in claim 1, wherein the elongated ribs are shaped like a flat plate and are arranged so as to extend radially from center to periphery.

* * * * *